US006299522B1

(12) United States Patent
Lee

(10) Patent No.: US 6,299,522 B1
(45) Date of Patent: Oct. 9, 2001

(54) GRINDING WHEEL FOR USE IN GRINDING APPARATUS

(75) Inventor: Chang Hyun Lee, Kyongki-Do (KR)

(73) Assignee: EHWA Diamond Ind. Co. Ltd, Kyongki-do (KR)

( * ) Notice: Subject to any disclaimer, the term of this patent is extended or adjusted under 35 U.S.C. 154(b) by 0 days.

(21) Appl. No.: 09/460,637

(22) Filed: Dec. 14, 1999

(30) Foreign Application Priority Data

Jul. 29, 1999 (KR) ..... 99-31136

(51) Int. Cl.[7] ..... B23F 21/03
(52) U.S. Cl. ..... 451/548; 451/488; 451/540
(58) Field of Search ..... 451/488, 548, 451/549, 550, 540

(56) References Cited

U.S. PATENT DOCUMENTS 5,911,620 * 6/1999 Spangenberg et al. ..... 451/548

FOREIGN PATENT DOCUMENTS 3607106 9/1987 (DE) .
2260721 4/1993 (GB) .

* cited by examiner

*Primary Examiner*—Timothy V. Eley
*Assistant Examiner*—Dung Van Nguyen
(74) *Attorney, Agent, or Firm*—Vidas, Arrett & Steinkraus, P.A.

(57) ABSTRACT

A grinding wheel having dust discharge-impelling blades which are able to impel to discharge the dust produced during the grinding operation to a dust collection machine to decrease dispersing dust in the air, and increase the cooling efficiency of the grinding wheel to enhance the grinding ability and the life of the grinding wheel.

The grinding wheel of the present invention comprises a shank for connecting with a shaft of electric motor, having a plurality of dust discharging holes disposed at given intervals in the shank and a plurality of dust discharge-impelling blades disposed between the dust discharging holes for impelling to discharge dust produced during the grinding operation through and in cooperation with dust discharging holes, and a plurality of grinding tips disposed fixedly at predetermined intervals on the lower surface of the circumferential portion of the shank by means of welding or joining.

17 Claims, 7 Drawing Sheets

GRINDING WHEEL FOR USE IN GRINDING APPARATUS

BACKGROUND OF THE INVENTION

1. Field of the Invention

The present invention relates to a grinding wheel for use in a grinding apparatus for grinding various materials such as brick, concrete, granite, marble, etc., and more particularly to a grinding wheel having dust discharge-impelling blades capable of impelling to discharge the dust produced during grinding operation to the dust collection machine to decrease dispersing the dust in the air, and increase cooling efficiency of the grinding wheel, thereby enhancing the grinding ability and the life of the grinding wheel.

2. Background of the Prior Art

Conventional grinding wheels 90 and 100 for use in grinding apparatus comprise plate type shanks 91 and 101 connected with a shaft of electric motor, and grinding tips 92 and 102 disposed fixedly in single or double circumferential array on shanks 91 and 101 by means of welding or joining, as shown in FIGS. 11 and 12.

Grinding tips 92 and 102 are fabricated by mixing particles of diamond or grinding materials, particles of metals composing of cobalt, nickel, bronze, copper, etc., or particles of resin or ceramic and forming a given shape out of the mixed particles by plastic working including press work.

On the shanks 91 and 101, there is a plurality of round shape holes 93 and 103 for discharging grinding particles or dusts produced during grinding operation through the dust inlet portion or the hood of a dust collection machine which is disposed on the shanks 91 and 101. Numerals 94 and 104 are rim portions.

In operation, the grinding wheels 90 and 100 are rotated at a high speed of about 10,000 RPM to let the grinding tips 92 and 102 to grind the materials in velocity of about 70 to 80 m/sec, and thereby the produced grinding particles or dust is carried with the centrifugal force corresponding to the moving velocity of the grinding tips 92 and 102 and inducted through the round shape holes 93 and 103 into the dust collection machine usually having air induction or wind velocity of about 25 to 30 m/sec and flux of about 1,000 to 1,300 l/minute when the diameter of a dust collection tube thereof is 30 mm.

However, at this time, since the air induction velocity of the dust collection tube of the dust collection machine is slower than the moving velocity of the grinding tips as noted above, i.e., the air induction force of the dust collection machine is smaller than the centrifugal force of grinding particles or dust, a large amount of grinding particles or dust was leaked out beyond the limits of the dust inlet portion of the dust collection machine disposed on the grinding wheels 90 and 100 for guiding dust to the dust collection tube of the dust collection machine, and dispersed in the air to give rise to the bad effect to users' health and the contamination of environment.

Further, since the air induction velocity for inducting dust into the dust collection tube of the dust collection machine is abruptly decreased to about 2 m/sec at a lower surface of the grinding tips 92 and 102, i.e., a surface of materials, it was almost impossible to improve the dust dispersing problem only by increasing the wind velocity of the dust collection machine.

Also, since the grinding tips 92 and 102 are cooled only by air circulation, the grinding tips 92 and 102 located in the position which air induction velocity is abruptly decreased, was-easily carbonized or oxidized and thereby defaced by friction heat between the materials and the grinding tips during the continuous grinding operation for a long time to induce poor grinding and decrease the grinding efficiency and the life of the wheel.

SUMMARY OF THE INVENTION

It is an object of the present invention to provide a grinding wheel having dust discharge-impelling blades which are capable of impelling to discharge the dust produced during grinding operation to a dust collection machine to decrease dispersing the dust in the air and thereby to prevent the dispersed dust from giving rise to the bad effects to users' health and the contamination of environment.

It is the other object of the present invention to provide a grinding wheel having dust discharge-impelling blades which are able to increase the cooling efficiency of the grinding wheel to enhance the cutting ability and the life of the grinding wheel.

To accomplish these objects, a grinding wheel for use in a grinding apparatus according to one embodiment of the present invention comprises a shank for connecting with a shaft of an electric motor, having a plurality of dust discharging holes disposed at given intervals in the shank and dust discharge-impelling means disposed between dust discharging holes for impelling to discharge the dust produced during grinding operation through and in cooperation with the dust discharging holes, and a plurality of grinding tips disposed fixedly at predetermined intervals on the lower surface of a circumferential portion of the shank by means of welding or joining.

In this embodiment of the present invention, the dust discharge-impelling means is composed of a plurality of dust discharge-impelling blades formed to be slanted in the rotation direction of the shank and respectively having upper and lower surfaces disposed to define boundaries of the dust discharging holes therebetween and inclined upwardly from a horizontal plane to produce the air propelling force for discharging dust when the shank is rotated by the electric motor.

The shank of the present invention further includes a layer for fixing the grinding tips disposed on the lower surface of the shank.

It is desirable that the layer is fixed by heat resistance adhesive or screws on the lower surface of the shank.

Alternatively, the union between the layer and the lower surface of the shank can be accomplished by female and male spiral portions formed respectively in the layer and the shank.

Also, each of the grinding tips is disposed diagonally from circumferential direction on the line projected from the end portion of the dust discharge-impelling blade to increase contacting area between the grinding tips and materials to be ground.

It is desirable that the width of dust discharging holes in the vicinity of the center of the shank is getting narrower than that in the vicinity of circumference thereof.

In another embodiment of the present invention, a grinding wheel for use in a grinding apparatus comprises a shank for connecting with a shaft of an electric motor, having a plurality of dust discharging openings disposed at given intervals in the shank and opened in the circumferential portion of the shank and dust discharge-impelling means disposed between the dust discharging openings for impelling to discharge the dust produced during grinding operation through and in cooperation with the dust discharging openings, and a plurality of grinding tips disposed fixedly at predetermined intervals on the lower surface of the end portion of dust discharge-impelling means by means of welding or joining.

In this embodiment of the present invention, the dust discharge-impelling means is composed of a plurality of dust discharge-impelling blades formed to be bent at a given radius in rotation direction of the shank and respectively having upper and lower surfaces disposed to define the boundaries of the dust discharging openings therebetween and inclined upwardly from a horizontal plane to produce the air propelling force for discharging dust when the shank is rotated by the electric motor.

It is desirable that each grinding tip and the end portion of each dust discharge-impelling blade for adhering corresponding grinding tip are bent diagonally from the circumferential direction to increase contacting area between the grinding tips and the materials to be ground.

The shank of the present invention further includes a layer for fixing a plurality of grinding tips disposed respectively on the lower surfaces of the end portions of dust discharge-impelling blades.

It is desirable that the layer is fixed by heat resistance adhesive or screws on the lower surface of the end portion of each dust discharge-impelling blade.

In the other embodiment of the present invention, a grinding wheel for use in an apparatus for grinding materials comprises a shank for connecting with a shaft of electric motor, having a plurality of dust discharging holes disposed at given intervals in the shank, a dust discharge-impelling means disposed fixedly under the dust discharging holes of the shank for impelling to discharge the dust produced during grinding operation through the dust discharging holes, and a plurality of grinding tips disposed fixedly at predetermined intervals on the lower surface of a circumferential portion of shank by means of welding or joining.

In this embodiment of the present invention, the dust discharge-impelling means is composed of a plurality of dust discharge-impelling blades disposed to be slanted in rotation direction of the shank under the dust discharging holes and inclined upwardly from a horizontal plane to produce the air propelling force for discharging dust when the shank is rotated by the electric motor.

The shank of the present invention further includes a layer for fixing the grinding tips disposed on the lower surface of the shank.

It is desirable that the layer is fixed by heat resistance adhesive or screws on the lower surface of the shank.

Alternatively, the union between the layer and the lower surface of the shank can be accomplished by female and male spiral portions formed respectively in the layer and the shank.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Now, embodiments of the present invention will be described with reference to FIG. 1 to FIG. 12 in which the same components are illustrated and shown as the same numerals.

Figure 1:
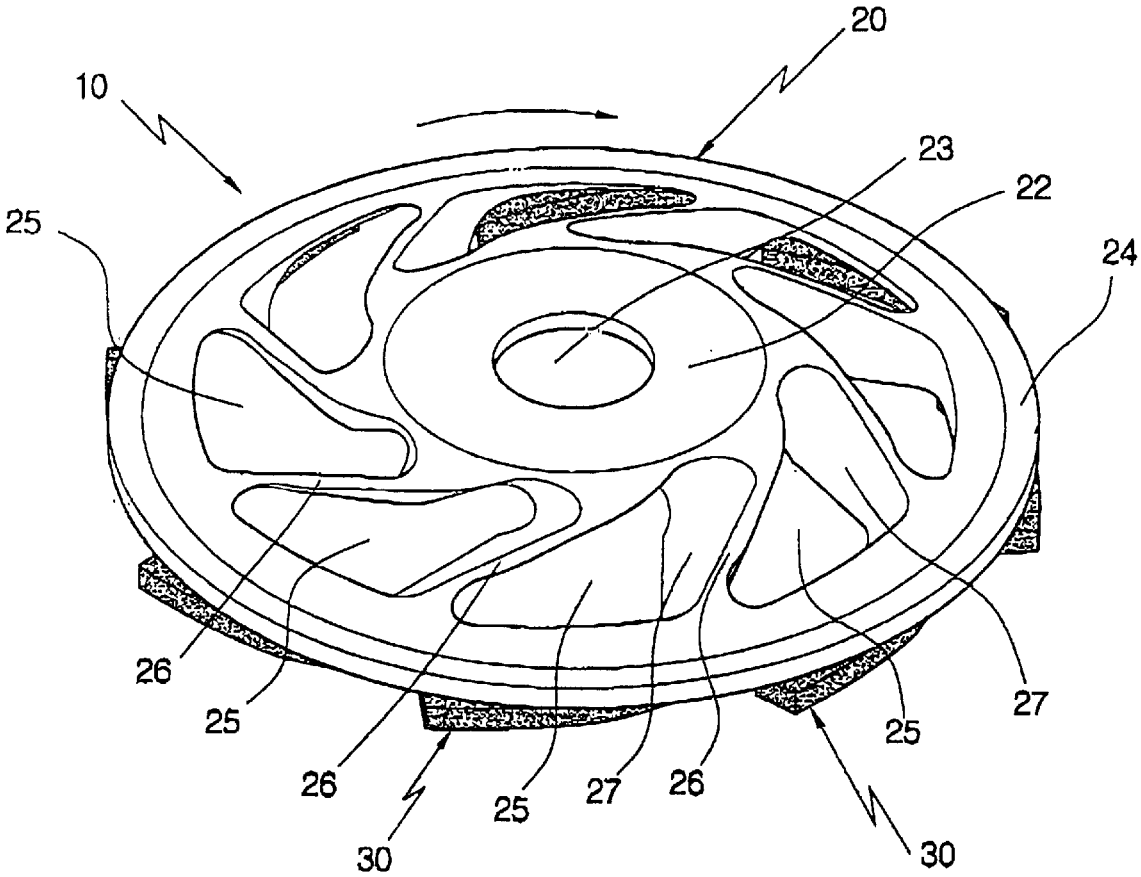
FIG. 1 is a perspective view of a grinding wheel for use in a grinding apparatus according to one embodiment of the present invention.
Figure 2:
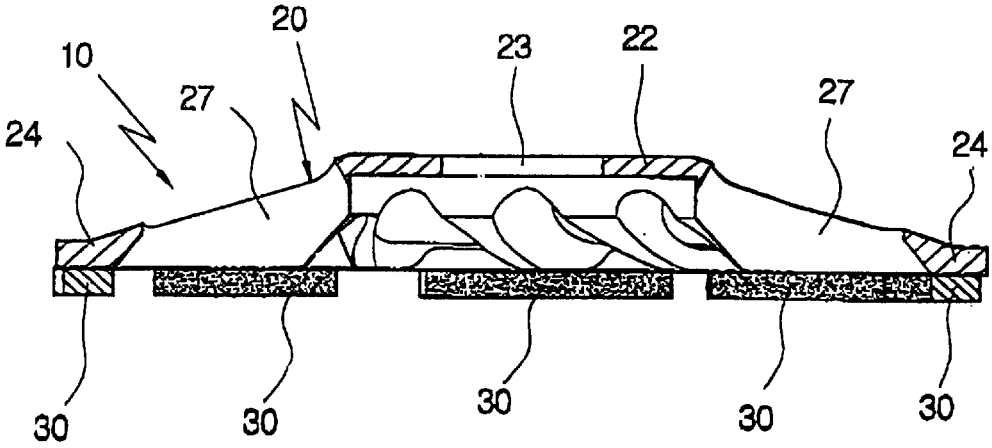
FIG. 2 is a cross-sectional view of the grinding wheel of the invention shown in FIG. 1.
Figure 3:
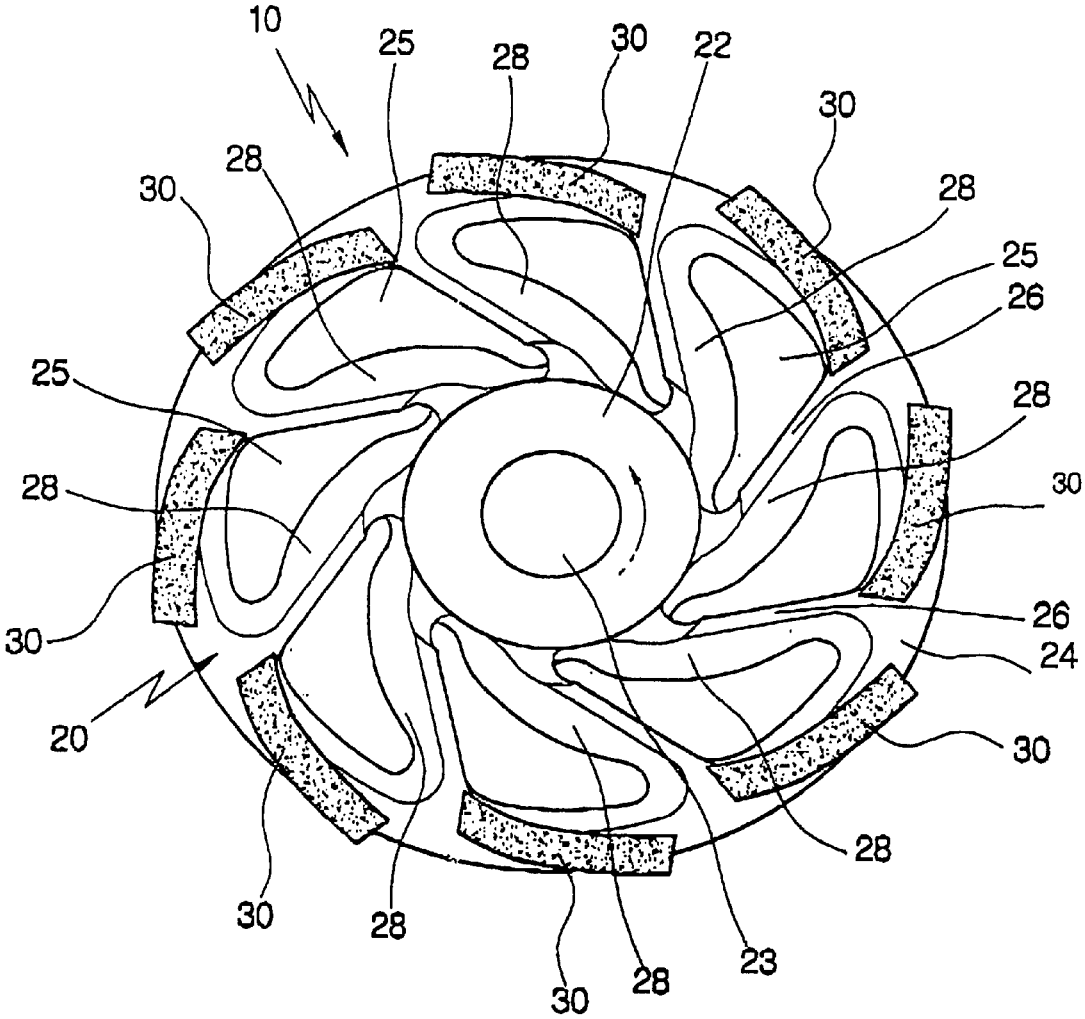
FIG. 3 is a bottom view of the grinding wheel of the invention shown in FIG. 1.

Referring to FIG. 1 to FIG. 3, there is illustrated a grinding wheel 10 for use in a grinding apparatus according to one embodiment of the present invention.

Grinding wheel 10 comprises a plate type shank 20 for connecting with a shaft of electric motor, and a plurality of grinding tips 30 disposed fixedly at predetermined intervals on the lower surface of the shank 20 by means of welding or joining.

The shank 20 according to the invention has a disc portion 22 having a hole 23 for receiving the shaft of electric motor, and a plurality of dust discharging holes 25 disposed at given intervals around the disc portion 22.

The shank 20 can be made of synthetic resin, or metal materials such as aluminum, steel, copper, etc.

It is desirable that the width of each dust discharging hole 25 in the vicinity of the center of the shank 20 is getting narrower than that in the vicinity of circumference thereof.

Also, the shank 20 includes a plurality of dust discharge-impelling blades 26 disposed between the dust discharging holes 25 for impelling to discharge dust produced during grinding operation through and in cooperation with the dust discharging holes 25, and a rim portion 24 for adhering grinding tips 30 on the lower surface thereof connected with the disc portion 22 through the dust discharge-impelling blades 26.

The dust discharging-impelling blades 26 are slanted in the rotation direction of the shank 20.

Each of the discharging-impelling blades 26 has upper and lower surfaces 27 and 28 disposed to define the boundaries of the dust discharging holes 25 and inclined upwardly from a horizontal plane to produce the air propelling force for discharging the dust ground by grinding tips 30 when the shank 20 is rotated by the electric motor.

In here, it is noted that besides forming the dust discharge-impelling blades 26 in shape slanted in the rotation direction of the shank 20 as explained above, it is possible to form the blades 26 in any other streamline or straight shape to be able to produce the air propelling force for discharging the dust.

Also, as shown in FIG. 3, it is desirable that each of the grinding tips 30 is disposed diagonally from the circumferential direction on the line projected from the end portion of the dust discharge-impelling blades 26 to increase contacting area between the grinding tips 30 and the materials to be ground.

Figure 4:
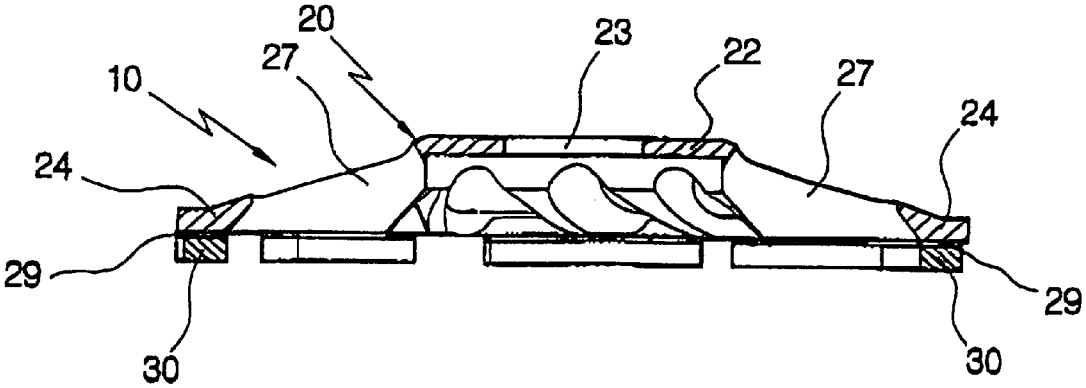
FIG. 4 is a cross-sectional view of a grinding wheel of the invention having a steel layer for fixing the grinding tips.

As shown in FIG. 4, a shank 20 of the present invention can include a steel layer 29 for fixing the grinding tips 30 disposed on the lower surface of the rim portion 24 of the shank 20.

The steel layer 29 is used to adhere the grinding tips on the shank by welding in case that the shank is made of materials such as aluminum or synthetic resins which are not able to be welded.

The steel layer 29 is fixed by heat resistance adhesive on the lower surface of the shank 20.

Figure 9A:
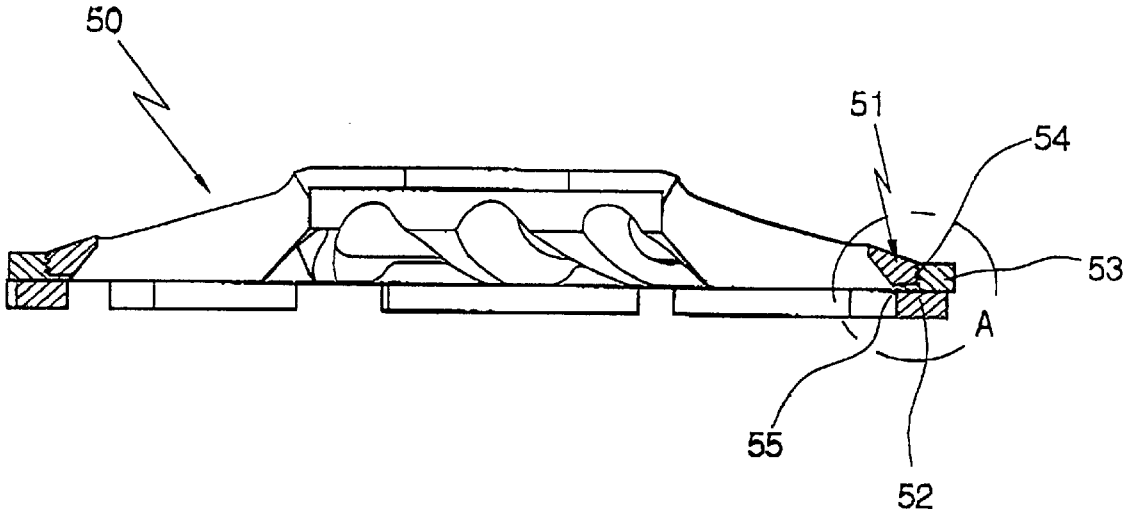
FIG. 9A respectively illustrates partial cross-sectional views of the grinding wheel of the present invention illustrating a state that a layer for fixing grinding tips is fixed on the lower surface of the shank.
Figure 9B:
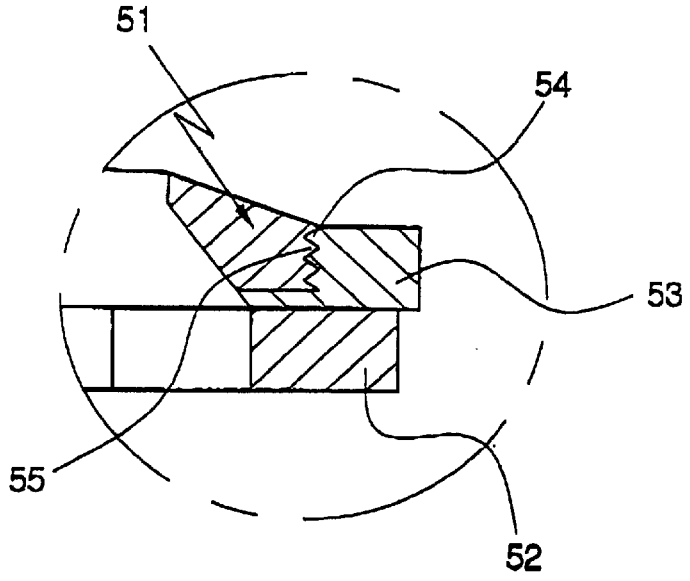
FIG. 9B illustrates a detailed view of 'A' portion in FIG. 9A.
Figure 10A:
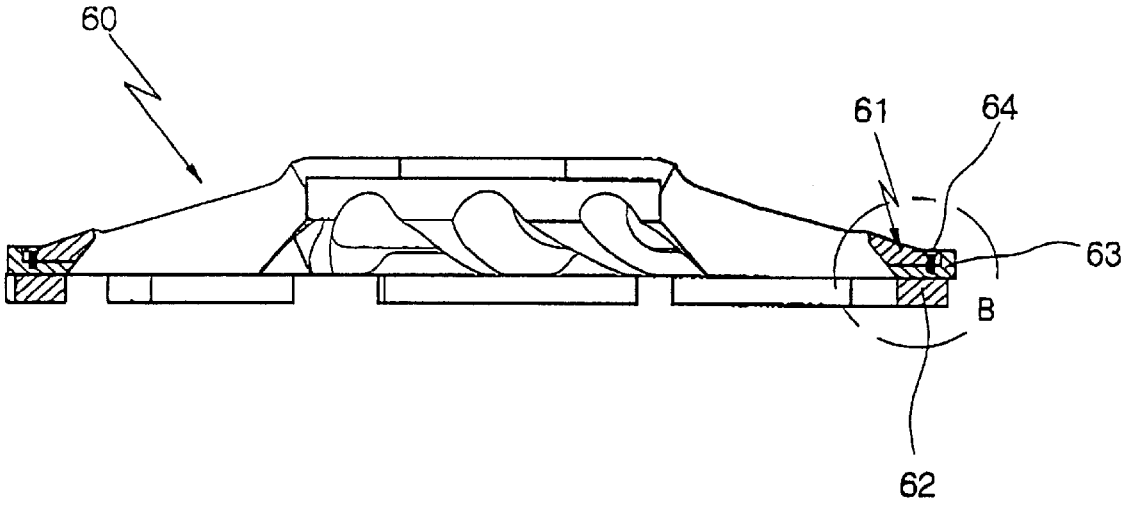
FIG. 10A illustrates partial cross-sectional views of the grinding wheel of the present invention illustrating a state that a layer for fixing grinding tips is fixed on the lower surface of the shank.
Figure 10B:
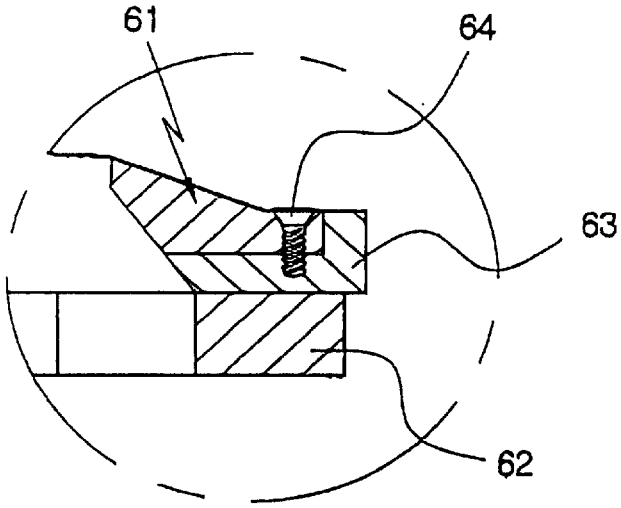
FIG. 10B illustrates a detailed view OF 'B' portion in FIG. 10A.
Figure 11:
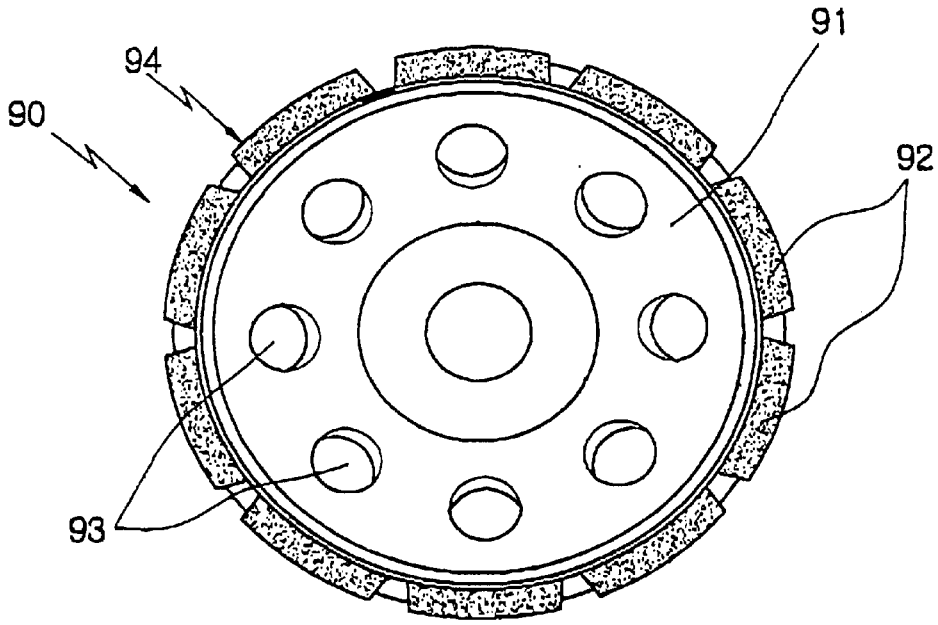
FIG. 11 (PRIOR ART)
FIG. 11 and FIG. 12 respectively illustrate bottom views of conventional grinding wheels for use in a grinding apparatus, each of which grinding tip is disposed in single or double circumferential array on the shank.
Figure 12:
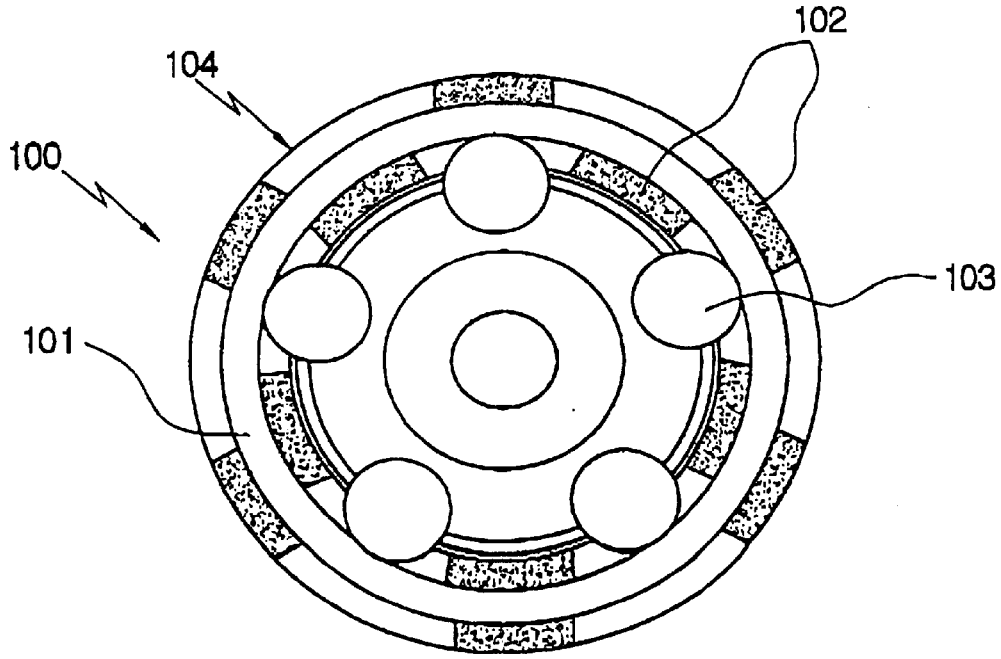
FIG. 12 (PRIOR ART)

Also, as shown in FIG. 9 and FIG. 10, steel, aluminum, or synthetic resin layers 53 and 63 for fixing the grinding tips 52 and 62 can be used to replace only grinding tip portions without replacing grinding wheels 50 and 60 as a whole when grinding tips 52 and 62 are completely defaced, and thereby reducing the replacing and maintenance costs of the grinding wheel machine.

In this case, a layer 63 is fixed by screws on the shank 61, as shown in FIG. 10.

Alternatively, the union between the layer 53 and the shank 51 can be accomplished by female and male spiral portions 54 and 55 formed respectively in the layer 53 and the shank 51, as shown in FIG. 9.

Figure 5:
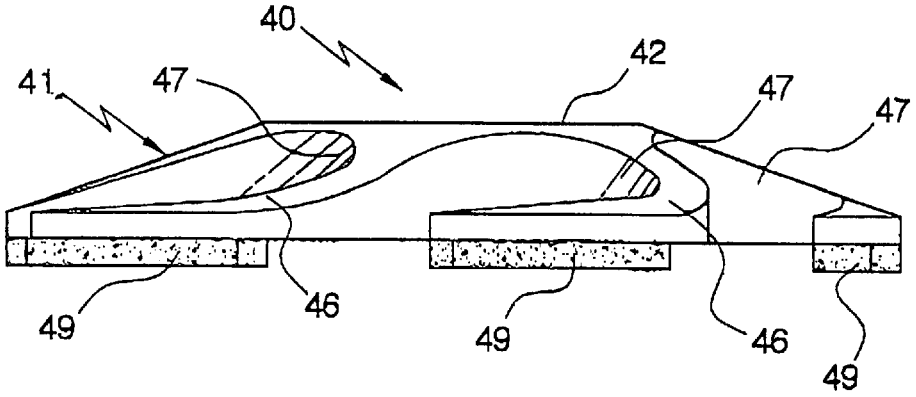
FIG. 5 and FIG. 6 are front and bottom views of a grinding wheel for use in a grinding apparatus according to another embodiment of the present invention.
Figure 6:
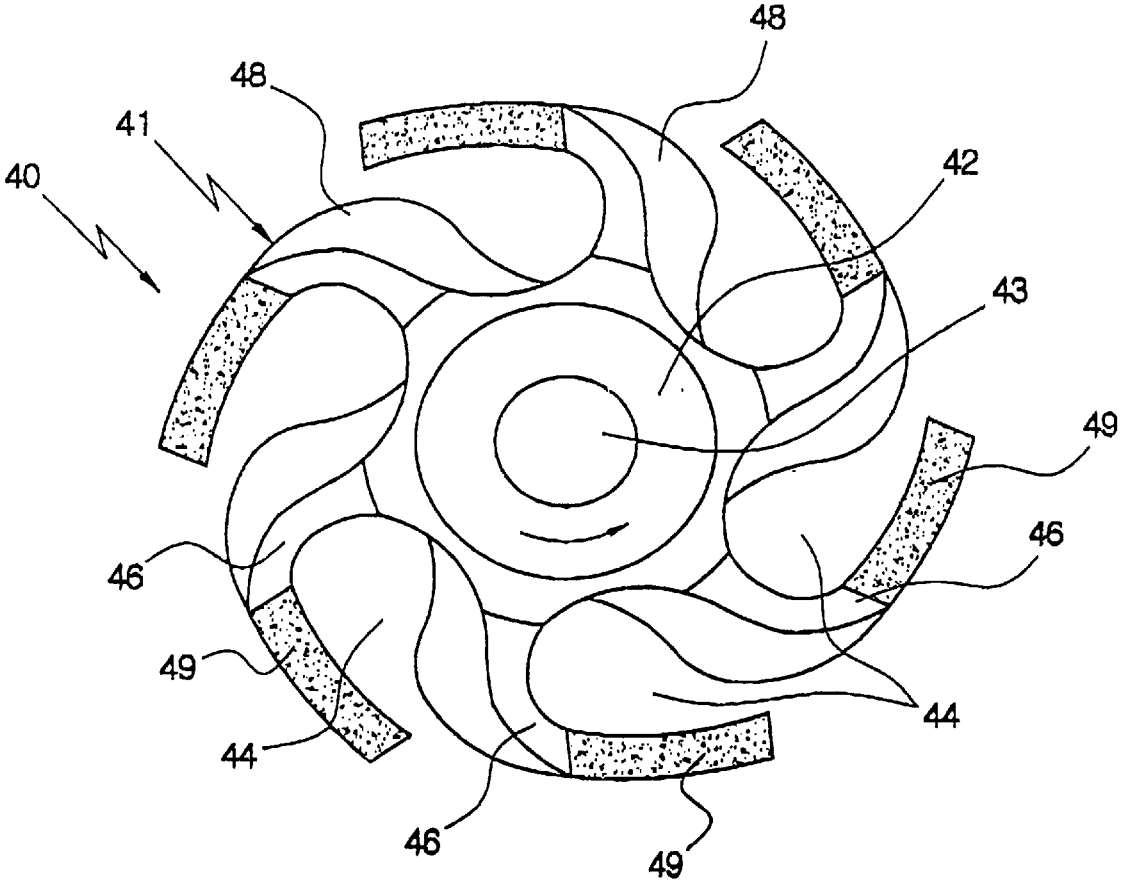

Referring to FIG. 5 and FIG. 6, there is illustrated a grinding wheel 40 for use in a grinding apparatus according to another embodiment of the present invention.

The grinding wheel 40 comprises a shank 41 including a disc portion 42 having a hole 43 for receiving the shaft of an electric motor, a plurality of dust discharging openings 44 disposed at given intervals around the disc portion 42 and opened in the circumferential portion of the shank 41, and a plurality of dust discharge-impelling blades 46 disposed between the dust discharging openings 44 for impelling to discharge dust produced during grinding operation through and in cooperation with the dust discharging openings 44.

The dust discharge-impelling blades 46 are respectively formed to be bent at a given radius in the rotation direction of the shank 41.

The dust discharge-impelling blades 46 have upper and lower surfaces 47 and 48 disposed to define the boundaries of the dust discharging openings 44 therebetween, respectively and inclined upwardly from a horizontal plane to produce the air propelling force for discharging the dust when shank 41 is rotated by the electric motor.

The grinding wheel 40 further includes a plurality of grinding tips 49 disposed fixedly at predetermined intervals on the lower surface of the end portion of the dust discharge-impelling blades 46 by means of welding or joining.

It is desirable that each grinding tip 49 and end portion of each dust discharge-impelling blade 46 for adhering corresponding grinding tip 49 are bent diagonally from circumferential direction to increase contacting area between the grinding tips 49 and the materials to be ground and thereby increasing the grinding ability of the grinding wheel 40.

Also, as in grinding wheel 10 shown in FIG. 4, a shank 41 can include a steel layer for fixing a plurality of grinding tips disposed respectively on the lower surfaces of end portions of dust discharge-impelling blades 46 to be able to adhere the grinding tips thereon by welding in case that shank is made of materials such as aluminum or synthetic resins which are not able to be welded.

Also, as in grinding wheels 50 and 60 shown in FIG. 9 and FIG. 10, a steel, aluminum, or synthetic resin layer for fixing the grinding tips 49 can be used to replace only grinding tip portions without replacing grinding wheel 40 as a whole when grinding tips 49 are completely defaced, and thereby reducing the replacing and maintenance costs of the grinding wheel machine.

Figure 7:
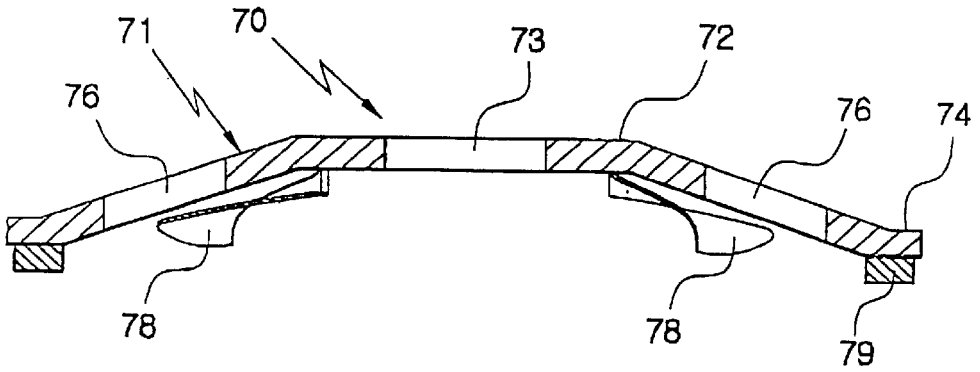
FIG. 7 and FIG. 8 respectively illustrate a cross-sectional view and a top plan view of a grinding wheel for use in grinding apparatus according to the other embodiment of the present invention.
Figure 8:
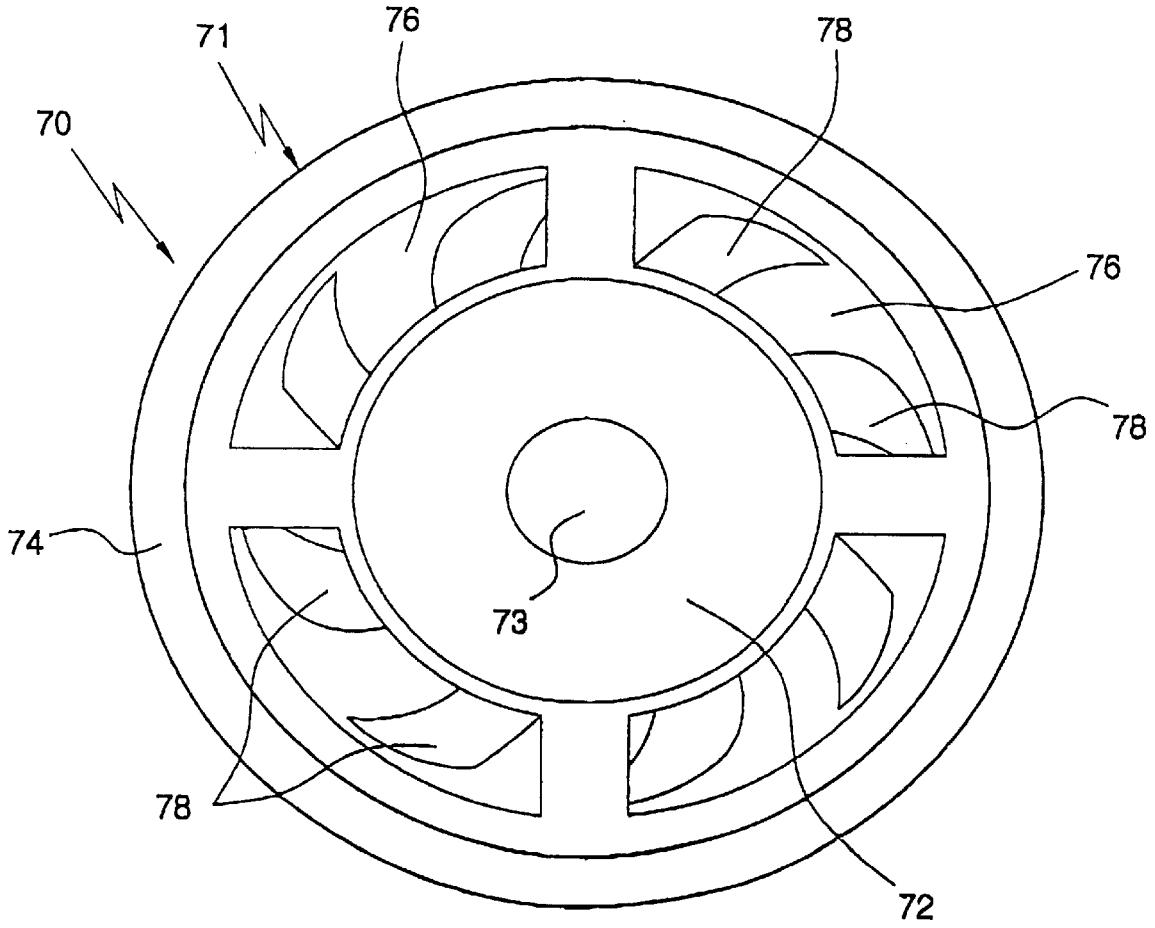

Referring to FIG. 7 and FIG. 8, there is illustrated a grinding wheel 70 for use in a grinding apparatus according to the other embodiment of the present invention.

A grinding wheel 70 comprises a shank 71 including a disc portion 72 having a hole 73 for receiving the shaft of electric motor, and a plurality of dust discharging holes 76 disposed at given intervals around disc portion 74.

The grinding wheel 70 further includes a plurality of dust discharge-impelling blades 78 disposed fixedly under the dust discharging holes 76 of the shank 71 for impelling to discharge the dust produced during grinding operation through the dust discharging holes 76, and a plurality of grinding tips 79 disposed fixedly at predetermined intervals on the lower surface of a circumferential portion of shank 71 by means of welding or joining.

It is desirable that dust discharge-impelling blades 78 are disposed to be a slant in the rotation direction of the shank 71 under dust discharging holes 76 and inclined upwardly from a horizontal plane to produce the air propelling force for discharging the dust when the shank 71 is rotated by the electric motor.

Also, dust discharge-impelling blades 78 can be fabricated separately or as one body with the shank 71, depending on the manufacturing condition, Also, as in grinding wheel 10 shown in FIG. 4, the shank 71 can include a steel layer 29 for fixing grinding tips 79 disposed on the lower surface of the shank 71 to be able to adhere grinding tips thereon by welding in case that the shank 71 is made of materials such as aluminum or synthetic resins which are not able to be welded.

Also, as in grinding wheels 50 and 60 shown in FIG. 9 and FIG. 10, steel, aluminum, or synthetic resin layers 53 and 63 for fixing the grinding tips 79 can be used to replace only grinding tip portions without replacing the grinding wheel 70 as a whole when the grinding tips 79 are completely defaced, and thereby reducing the replacing and maintenance costs of the grinding wheel machine.

Operation of grinding wheels for use in grinding apparatus according to embodiments of the present invention will be described, hereinafter.

Since the operation of grinding wheel 10 illustrated in FIG. 1 to FIG. 3 is the same as that of grinding wheels 40 and 70 shown in FIG. 5 to FIG. 8, only the operation of grinding wheel 10 will be explained.

At first, when a grinding wheel 10 is rotated at a high speed of 10,000 RPM by an electric motor on materials such as brick, concrete, granite, marble, etc., grinding tips 30 begin to grind materials.

By the grinding operation of grinding tips 30, grinding particles or dusts are produced and discharged through dust discharging holes 25 of a shank 20 to a dust collection machine by the air induction force of the dust collection machine.

At this time, grinding particles or dust is carried with the centrifugal force corresponding to the moving velocity of grinding tip 30 and thereby urging to be leaked out beyond the limits of the dust inlet portion or the hood of the dust collection machine disposed on grinding wheel 10 for guiding dust to a dust collection tube of the dust collection machine.

However, since dust discharge-impelling blades 26 also produce the air propelling force for discharging dust to the dust collection tube of the dust collection machine when a shank 20 is rotated by the electric motor, air induction velocity for discharging dust into a dust collection machine at lower surfaces 28 of grinding tips 30 is increased by five times as large as that obtained by means of only a dust collection machine, i.e., by about 10 m/sec to neutralize the centrifugal force of grinding particles or dust and thereby the produced grinding particles are prevented fundamentally from leaking out beyond the limits of the dust inlet portion and dispersing in the air to give rise to the bad effect to users' health and the contamination of environment.

Also, the removal speed of grinding particles is increased by 20 to 60% according to the kinds of materials to be ground and cooling efficiency is also enhanced.

In this way, by repeating the operation of grinding wheel 10, the grinding operation of materials is completed.

As apparent from the foregoing description, it can be appreciated that the present invention provides a grinding wheel having dust discharge-impelling blades which are able to impel to discharge dust produced during grinding operation to the dust collection machine to decrease dispersing dusts in the air and thereby to prevent the dispersed dusts from giving rise to the bad effect to users' health and the contamination of environment.

Also, the present invention provides a grinding wheel having dust discharge-impelling blades which are able to increase the cooling efficiency of the grinding wheel to enhance grinding ability and the life of the grinding wheel.

What is claimed is:

1. A grinding wheel for use in a grinding apparatus comprising:

a shank for connecting with a shaft of an electric motor, said shank having an upper and a lower surface and having a plurality of dust discharging holes disposed at given intervals in said shank and dust discharge-impelling means disposed between said dust discharging holes for impelling to discharge the dust produced during grinding operation through and in cooperation with said dust discharging holes; and a plurality of grinding tips disposed fixedly at predetermined intervals on the lower surface of a circumferential portion of said shank, wherein said dust discharge-impelling means is composed of a plurality of dust discharge-impelling blades which define said dust discharging holes, said blades being angularly offset from a radial line in rotation direction of said shank and said blades each having a face with a bottom and top edge, said bottom edge being on said lower surface of said shank and said bottom edge being forward with respect to the top edge and the direction of rotation to produce air propelling force for discharging dust when said shank is rotated by the electric motor, said shank further includes a layer for fixing said grinding tips disposed on the lower surface of said shank.

2. The grinding wheel as claimed in claim 1, wherein said shank further includes a layer for fixing said grinding tips disposed on the lower surface of said shank.

3. The grinding wheel as claimed in claim 2, wherein said layer is fixed by heat resistance adhesive on the lower surface of said shank.

4. The grinding wheel as claimed in claim 2, wherein said layer is fixed by screws on the lower surface of said shank.

5. The grinding wheel as claimed in claim 2, wherein the union between said layer and the lower surface of said shank is accomplished by female and male spiral portions formed respectively in said layer and said shank.

6. The grinding wheel as claimed in claim 1, wherein each of said grinding tips is angularly offset from a line projected from said dust discharge impelling blades to increase the contacting area between said grinding tips and materials to be ground.

7. The grinding wheel as claimed in claim 1, wherein the width of dust discharging holes increases toward the circumferential portion of said shank.

8. A grinding wheel for use in a grinding apparatus comprising:

a shank for connecting with a shaft of an electric motor, said shank having an upper and a lower surface and having a plurality of dust discharging openings disposed at given intervals in the shank and being open through the circumference of said shank and dust discharge-impelling means disposed between said dust discharging openings for impelling to discharge the dust produced during grinding operation through and in cooperation with said dust discharging openings; and a plurality of grinding tips disposed fixedly at predetermined intervals on the lower surface of the dust discharge-impelling means, wherein said dust discharge-impelling means is composed of a plurality of dust discharge-impelling blades angular offset from a radial line in the rotation direction of said shank said blades each having a face with a bottom and top edge, said bottom edge being on said lower surface of said shank and said bottom edge being forward with respect to the top edge and the direction of rotation to produce air propelling force for discharging dust when said shank is rotated by the electric motor.

9. The grinding wheel as claimed in claim 8, wherein each grinding tip and an end of each dust discharge-impelling blade at the circumference of said shank for adhering corresponding grinding tip are angularly offset from a radial line in the rotation direction of said shank to increase the contacting area between said grinding tips and the materials to be ground.

10. The grinding wheel as claimed in claim 8, wherein said shank further includes a layer for fixing said grinding tips disposed respectively on the lower surfaces of the dust discharge-impelling blades.

11. The grinding wheel as claimed in claim 10, wherein each layer is fixed by heat resistance adhesive on the lower surface of each dust discharge-impelling blade.

12. The grinding wheel as claimed in claim 10, wherein each layer is fixed by screws on the lower surface of each dust discharge-impelling blade.

13. A grinding wheel for use in grinding apparatus comprising:

a shank for connecting with a shaft of an electric motor, said shank having an upper and a lower surface and having a plurality of dust discharging holes disposed at given intervals in said shank;

a dust discharge-impelling means disposed fixedly under said dust discharging holes of said shank for impelling to discharge the dust produced during grinding operation through said dust discharging holes; and a plurality of grinding tips disposed fixedly at predetermined intervals on the lower surface of a circumferential portion of said shank, wherein said dust discharge-impelling means is composed of a plurality of dust discharge-impelling blades, said blades being angularly offset from a radial line in rotation direction of said shank under said dust discharging holes, said blades each having a face with a bottom and a top edge, said bottom edge being forward with respect to the top edge and the direction of rotation to produce the air propelling force for discharging dust when said shank is rotated by the electric motor.

14. The grinding wheel as claimed in claim 13, wherein said shank further includes a layer for fixing said grinding tips disposed on the lower surface of said shank.

15. The grinding wheel as claimed in claim 14, wherein said layer is fixed by heat resistance adhesive on the lower surface of said shank.

16. The grinding wheel as claimed in claim 14, wherein said layer is fixed by screws on the lower surface of said shank.

17. The grinding wheel as claimed in claim 14, wherein the union between said layer and the lower surface of said shank can be accomplished by female and male spiral portions formed respectively in said layer and said shank.

* * * * *